US011891712B2

(12) United States Patent
Wu et al.

(10) Patent No.: US 11,891,712 B2
(45) Date of Patent: Feb. 6, 2024

(54) METHOD FOR PREPARING ORGANIC-INORGANIC HYBRID NANOFLOWER BY ELECTRODEPOSITION

(71) Applicant: GUILIN UNIVERSITY OF TECHNOLOGY, Guangxi (CN)

(72) Inventors: Xiaoli Wu, Guangxi (CN); Ke Ren, Guangxi (CN); He Zhang, Guangxi (CN); Zewen He, Guangxi (CN); Yuanli Liu, Guangxi (CN)

(73) Assignee: Guilin University of Technology, Guilin (CN)

( * ) Notice: Subject to any disclaimer, the term of this patent is extended or adjusted under 35 U.S.C. 154(b) by 99 days.

(21) Appl. No.: 17/417,507

(22) PCT Filed: Dec. 21, 2020

(86) PCT No.: PCT/CN2020/137870
§ 371 (c)(1),
(2) Date: Jun. 23, 2021

(87) PCT Pub. No.: WO2021/135998
PCT Pub. Date: Jul. 8, 2021

(65) Prior Publication Data

US 2022/0333263 A1 Oct. 20, 2022

(30) Foreign Application Priority Data

Jan. 4, 2020 (CN) ..... 202010007327.7

(51) Int. Cl.
*C25D 1/00* (2006.01)
*C25D 9/00* (2006.01)
(Continued)

(52) U.S. Cl.
CPC ..... *C25D 1/006* (2013.01); *C25D 9/00* (2013.01); *C25D 9/02* (2013.01); *C25D 9/08* (2013.01)

(58) Field of Classification Search
None
See application file for complete search history.

(56) References Cited

FOREIGN PATENT DOCUMENTS

CN 103499625 A * 1/2014
CN 103499625 A 1/2014
(Continued)

OTHER PUBLICATIONS

The International Search Report (ISR) for PCT/CN2020/137870 dated Mar. 5, 2021, pp. 1-5.
(Continued)

*Primary Examiner* — Louis J Rufo
(74) *Attorney, Agent, or Firm* — McDonnell Boehnen Hulbert & Berghoff LLP

(57) ABSTRACT

A method for preparing organic-inorganic hybrid nanoflower by electrodeposition is provided, which relates to the technical field of enzyme immobilization. An aqueous solution of a rare earth nitrate is mixed with a biological enzyme and a nitrate to obtain a mixed solution; the rare earth ions in the rare earth nitrate are one or more selected from La, Ce, Pr, Nd, Sm, Eu, Gd, Tb, Dy, Ho, Er, Yb and Y ions; the biological enzyme is α-amylase, horseradish peroxidase or laccase; then, the mixed solution is electrodeposited with a three-electrode system consisting of a working electrode, a counter electrode and a reference electrode to obtain an electrodeposited film on the surface of the working electrode; thereafter, the electrodeposited film is washed and dried successively to obtain organic-inorganic hybrid nanoflower.

20 Claims, 11 Drawing Sheets

(51) Int. Cl.
*C25D 9/08* (2006.01)
*C25D 9/02* (2006.01)

(56) References Cited

FOREIGN PATENT DOCUMENTS

| | | | | | |
|---|---|---|---|---|---|
| CN | 108130321 | A | | 6/2018 | |
| CN | 109234261 | A | | 1/2019 | |
| CN | 111172571 | A | | 5/2020 | |
| CN | 112552914 | A | * | 3/2021 | ..... C07K 17/02 |

OTHER PUBLICATIONS

Zhang, Chao et al. "Facile electrochemical synthesis of CeO2 hierarchical nanorods and nanowires with excellent photocatalytic activities" New J. Chem. (2014) vol. 38, 2581-2586.
Chen, Zhi et al. "A fast electrodeposition method for fabrication of lanthanum superhydrophobic surface with hierarchical micro-nanostructures" Colloids and Surfaces A: Physicochem. Eng. Aspects 401 (2012), pp. 1-7.

* cited by examiner

METHOD FOR PREPARING ORGANIC-INORGANIC HYBRID NANOFLOWER BY ELECTRODEPOSITION

CROSS REFERENCE TO RELATED APPLICATION

This patent application is a U.S. national phase of International Application No. PCT/CN2020/137870 filed on Dec. 21, 2020, which claims the benefit and priority of Chinese Patent Application No. 202010007327.7, entitled "Method for Preparing Organic-Inorganic Hybrid Nanoflower by Electrodeposition" filed on Jan. 4, 2020, the disclosure of which is incorporated by reference herein in its entirety.

TECHNICAL FIELD

The present disclosure relates to the technical field of enzyme immobilization, in particular to a method for preparing organic-inorganic hybrid nanoflower by electrodeposition.

BACKGROUND ART

At present, biological enzymes are widely used in biofuel production, drug synthesis, chemical and biological analysis, food processing and other related fields. However, free biological enzymes have problems such as poor stability and difficulty in recycling. In view of the above situation, immobilized enzymes emerge. Immobilized enzyme refers to the combination of a free enzyme and a carrier by use of physical or chemical methods to increase the stability of the enzyme. Inorganic nanomaterials are usually used as carriers for immobilized enzymes because of their large specific surface area, high mechanical strength, and good biocompatibility. The immobilized enzymes thus obtained are organic-inorganic hybrid materials.

Compared with free enzymes, immobilized enzymes have the following advantages: They can improve the stability of free enzymes, improve the reusability of enzymes, and make product separation easier. However, the synthesis of most immobilized enzymes is carried out under harsh conditions, such as high temperature and high pressure or the use of toxic organic solvents. As a result, the catalytic performance of the immobilized biological enzymes is reduced, which hinders the wide application of these biocatalytic systems. Therefore, how to increase the activity of the immobilized enzymes has become an urgent problem to be solved.

Currently, a common method for preparing immobilized enzymes (organic-inorganic hybrid materials) with inorganic nanomaterials as carriers is the co-precipitation method, but the preparation time is relatively long (48 to 96 hours), and the preparation efficiency is relatively low.

SUMMARY

In view of the above, it is an object of the present disclosure to provide a method for preparing organic-inorganic hybrid nanoflower by electrodeposition. In the present disclosure, the electrodeposition method is used to prepare the organic-inorganic hybrid nanoflower, which takes a shorter time, and can even be completed within a few minutes. The preparation efficiency is higher.

In order to achieve the above object of the present disclosure, the present disclosure provides the following technical solutions:

The present disclosure provides a method for preparing organic-inorganic hybrid nanoflower by electrodeposition, comprising the following steps:

(1) Mixing an aqueous solution of a rare earth nitrate with a biological enzyme and a nitrate to obtain a mixed solution; the rare earth ions in the rare earth nitrate are one or more selected from La, Ce, Pr, Nd, Sm, Eu, Gd, Tb, Dy, Ho, Er, Yb and Y ions; the biological enzyme is α-amylase, horseradish peroxidase or laccase;

(2) Electrodepositing the mixed solution obtained in step (1) with a three-electrode system consisting of a working electrode, a counter electrode and a reference electrode to obtain an electrodeposited film on the surface of the working electrode; the electrodeposition is a constant voltage deposition, and the deposition voltage is −0.8 to −1.3 v;

(3) Washing and drying the electrodeposited film successively to obtain organic-inorganic hybrid nanoflower.

Preferably, the molar concentration of rare earth ions in the aqueous solution of a rare earth nitrate is 0.005 to 0.5 mol/L.

Preferably, the concentration of the biological enzyme in the aqueous solution of a rare earth nitrate is 0.001 to 1 mg/mL.

Preferably, the nitrate includes one or more selected from ammonium nitrate, potassium nitrate and sodium nitrate; the molar ratio of the nitrate to the rare earth ion is 1 to 10:1.

Preferably, the working electrode includes transparent conductive glass, metal material or carbon material; the counter electrode is a Pt mesh; the reference electrode is an $Ag/AgCl/Cl^-$ electrode.

Preferably, the transparent conductive glass is glass coated with an ITO, FTO or AZO layer on one side of the surface.

Preferably, the temperature of electrodeposition is 15 to 60° C.

Preferably, the time of electrodeposition is 1 minute to 3 hours.

Preferably, the washing is carried out by using deionized water and absolute ethanol successively.

Preferably, the temperature of drying is 30 to 60° C.

The present disclosure provides a method for preparing organic-inorganic hybrid nanoflower by electrodeposition. In the present disclosure, an aqueous solution of a rare earth nitrate is mixed with a biological enzyme and a nitrate to obtain a mixed solution; the rare earth ions in the rare earth nitrate are one or more selected from La, Ce, Pr, Nd, Sm, Eu, Gd, Tb, Dy, Ho, Er, Yb and Y ions; the biological enzyme is α-amylase, horseradish peroxidase or laccase; then, the mixed solution is electrodeposited with a three-electrode system consisting of a working electrode, a counter electrode and a reference electrode to obtain an electrodeposited film on the surface of the working electrode; thereafter, the electrodeposited film is washed and dried successively to obtain organic-inorganic hybrid nanoflower. In the present disclosure, organic-inorganic hybrid nanoflower is prepared by the electrodeposition method for the first time. During electrodeposition, when the applied voltage reaches a certain value, the water near the working electrode obtains electrons and undergoes a reduction reaction, which generates hydroxide ions on the surface of the working electrode, whereby the rare earth ions, hydroxide ions and nitrate ions near the working electrode are deposited on the surface of the working electrode when the concentration product thereof reaches the critical condition for the formation of stable layered rare earth hydroxides. At the same time, the free enzyme near the working electrode is combined with the layered rare earth hydroxides by coordinating with the rare earth ions and by intercalating to obtain hybrid nanoflower on the surface of the working electrode, that is, a structure with a flower-like morphology formed by compounding layered rare earth compounds as the inorganic carrier with a biological enzyme as the organic component. The preparation of organic-inorganic hybrid nanoflower by the electrodeposition method in the present disclosure takes a shorter time and has a higher preparation efficiency; the operation is simple, and the crystalline form of the prepared organic-inorganic hybrid nanoflower has high regularity and improves the catalytic performance of the biological enzyme.

DETAILED DESCRIPTION OF THE EMBODIMENTS

Figure 1:
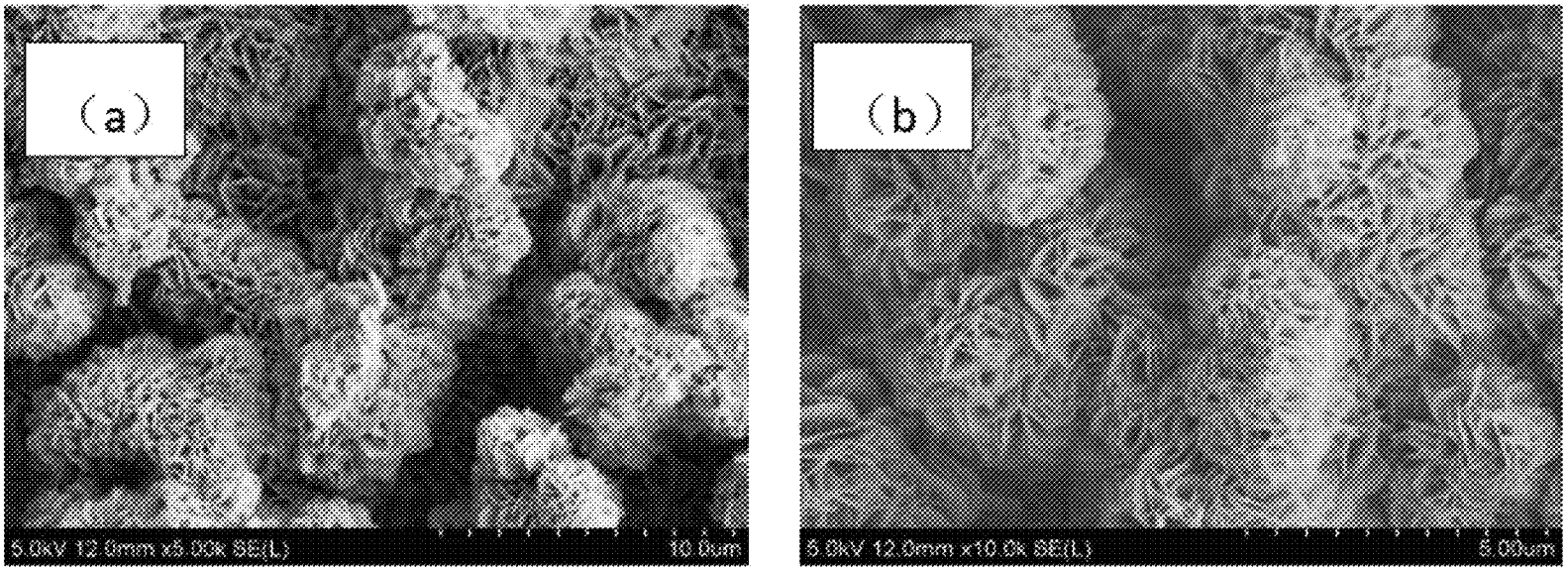
FIG. 1 is an SEM image of the organic-inorganic hybrid nanoflower prepared in Example 1, in which (a) and (b) are SEM images at different magnifications, respectively.

The present disclosure provides a method for preparing organic-inorganic hybrid nanoflower by electrodeposition, comprising the following steps:

(1) Mixing an aqueous solution of a rare earth nitrate with a biological enzyme and a nitrate to obtain a mixed solution; the rare earth ions in the rare earth nitrate are one or more selected from La, Ce, Pr, Nd, Sm, Eu, Gd, Tb, Dy, Ho, Er, Yb and Y ions; the biological enzyme is α-amylase, horseradish peroxidase or laccase;

(2) Electrodepositing the mixed solution obtained in step (1) with a three-electrode system consisting of a working electrode, a counter electrode and a reference electrode to obtain an electrodeposited film on the surface of the working electrode; the electrodeposition is a constant voltage deposition, and the deposition voltage is −0.8 to −1.3 v;

(3) Washing and drying the electrodeposited film successively to obtain organic-inorganic hybrid nanoflower.

In the present disclosure, an aqueous solution of a rare earth nitrate is mixed with a biological enzyme and a nitrate to obtain a mixed solution. In the present disclosure, the aqueous solution of a rare earth nitrate is preferably obtained by dissolving a rare earth nitrate into water. In the present disclosure, the chemical composition of the rare earth nitrate is preferably $Ln(NO_3)_3.6H_2O$; the Ln in the $Ln(NO_3)_3.6H_2O$ is one or more selected from La, Ce, Pr, Nd, Sm, Eu, Gd, Tb, Dy, Ho, Er, Yb and Y. When the rare earth nitrate is a mixture of the above rare earth nitrates, the mixing ratio is not particularly limited in the present disclosure, and they can be mixed in any ratio. In the present disclosure, the water is preferably deionized water; the molar concentration of rare earth ions ($Ln^{3+}$) in the aqueous solution of a rare earth nitrate is preferably from 0.005 to 0.5 mol/L, more preferably from 0.05 to 0.45 mol/L. In the present disclosure, the biological enzyme is α-amylase, horseradish peroxidase or laccase; the content ratio of the biological enzyme to the aqueous solution of a rare earth nitrate is preferably 0.001 to 1 mg:1 mL, more preferably 0.1 to 0.9 mg:1 mL. The source of the biological enzyme is not particularly limited in the present disclosure, and commercially available biological enzymes can be used. In the present disclosure, the nitrate preferably includes one or more selected from ammonium nitrate, potassium nitrate and sodium nitrate; the molar ratio of the nitrate to the rare earth ion is preferably 1 to 10:1, more preferably 3 to 6:1; the addition of nitrates is to provide sufficient nitrate ions to better form layered rare earth compounds that immobilize enzymes; when the amount of the added nitrates is too small, the concentration of nitrate ions is too low and the effect is not obvious. When the amount of the added nitrates is too large, the solution is acidic, and it is unfavorable to the activity of biological enzymes. In the present disclosure, the mixing is preferably carried out under stirring conditions; the speed and time of the stirring are not particularly limited in the present disclosure, as long as the biological enzyme can be uniformly mixed with the aqueous solution of a rare earth nitrate and the nitrate.

After obtaining the mixed solution, it is electrodeposited with a three-electrode system in the present disclosure which consists of a working electrode, a counter electrode and a reference electrode to obtain an electrodeposited film on the surface of the working electrode. In the present disclosure, the working electrode preferably comprises a transparent conductive glass, a metal material or a carbon material, more preferably a transparent conductive glass; the transparent conductive glass is preferably glass coated with an ITO, FTO or AZO layer on one side of the surface; the counter electrode is preferably a Pt mesh; the reference electrode is preferably an Ag/AgCl/$Cl^-$ electrode. In the present disclosure, the temperature of electrodeposition is preferably 15 to 60° C., more preferably 25 to 45° C.; the conditions of electrodeposition are mild, and within the temperature range where the enzyme maintains its activity. In the present disclosure, the mixed solution is preferably placed in a water bath, so that the temperature reaches the temperature of electrodeposition to obtain a standby electrodeposition solution; then, the three-electrode system is inserted into the standby electrodeposition solution to carry out electrodeposition.

In the present disclosure, the deposition voltage of electrodeposition is preferably −0.8 to −1.3 v, more preferably −0.9 to −1.1 v. During electrodeposition, at the described deposition voltages, the water near the working electrode obtains electrons to undergo a reduction reaction, and generates hydroxide ions ($H_2O+NO_3^-+2e \rightarrow 2OH^-+NO_2$) on the surface of the working electrode, whereby the rare earth ions, hydroxide ions and nitrate ions near the working electrode are deposited on the surface of the working electrode when the concentration product thereof reaches the critical condition for the formation of stable layered rare earth hydroxides ($Ln_2(OH)_5NO_3.nH_2O$, n=1.1 to 2.5). At the same time, the free enzyme near the working electrode is combined with the layered rare earth hydroxides by coordinating with the rare earth ions and by intercalating to obtain hybrid nanoflower on the surface of the working electrode, that is, a structure with a flower-like morphology formed by compounding layered rare earth compounds as the inorganic carrier with a biological enzyme as the organic component, namely the electrodeposited film obtained by deposition on the surface of the working electrode.

In the present disclosure, the time of electrodeposition is preferably 1 minute to 3 hours, more preferably 3 minutes to 30 hours. The preparation of organic-inorganic hybrid nanoflower by use of the electrodeposition method in the present disclosure takes a shorter time, and can even be completed within a few minutes. The preparation efficiency is higher.

After obtaining the electrodeposited film, the electrodeposited film is washed and dried successively to obtain organic-inorganic hybrid nanoflower. In the present disclosure, the washing is carried out by using deionized water and absolute ethanol successively. The number of washing is not particularly limited in the present disclosure, as long as the electrodeposited film can be cleaned up. In the present disclosure, the washing can remove the rare earth nitrate solution on the surface of the electrodeposited film. The layered rare earth hydroxides contain hydroxide radicals, and the rare earth nitrate solution is acidic. If the electrodeposited film is not washed, the rare earth nitrate solution remaining on the surface of the layered rare earth hydroxide film will corrode the layered rare earth hydroxides, thereby affecting the microscopic morphology, uniformity and adhesion of the organic-inorganic hybrid nanoflower. In the present disclosure, the temperature of drying is preferably 30 to 60° C., more preferably 30 to 45° C. The time of drying is not particularly limited in the present disclosure, as long as it can ensure the removal of water from the washed solids. After drying, the electrodeposited film in the present disclosure is preferably scraped gently from the working electrode with a clean blade to obtain an organic-inorganic hybrid nanoflower.

In the present disclosure, the organic-inorganic hybrid nanoflower is prepared by use of an electrodeposition method: Firstly, a rare earth nitrate solution is mixed with a biological enzyme and a nitrate, and the biological enzyme is incorporated into the mixed solution of a rare earth nitrate and a nitrate to form a uniform and stable precursor solution. Then, the precursor solution is subjected to electrodeposition, and the layered rare earth compound ($Ln_2(OH)_5NO_3.nH_2O$, n=1.1 to 2.5) thus formed and the biological enzymes are uniformly self-assembled to generate organic-inorganic hybrid nanoflower. The layered rare earth compound is used as the inorganic carrier of the organic biological enzyme. The rare earth ions in the layered rare earth compound provide empty orbitals for the coordination of free enzymes, and the special layered structure provides space for the adsorption of enzymes. At the same time, the synergy between rare earth ions and biological enzymes can improve the catalytic performance of the immobilized enzymes. Besides, the flower-like morphology has a higher specific surface area and surface energy than zero-dimensional nanoparticles and one-dimensional nanotubes or nanorods, which increases the mass transfer between the immobilized enzyme and the reaction substrate, thereby further improving the catalytic performance of the enzyme. Therefore, the present disclosure uses the electrodeposition method to prepare organic-inorganic hybrid nanoflower, and employs the layered rare earth compound as the inorganic carrier to load biological enzymes and form flower-like immobilized enzymes. Compared with free enzymes, the resulting immobilized enzymes have higher catalytic performance, are easier to be stored, and also can be more conveniently separated from products in practical applications.

In the present disclosure, organic-inorganic hybrid nanoflower is prepared by the electrodeposition method for the first time. The preparation time is shorter; the preparation efficiency is higher; the operation is simple; and the crystalline form of the prepared organic-inorganic hybrid nanoflower has high regularity and improves the catalytic performance of biological enzymes.

The method for preparing organic-inorganic hybrid nanoflower by electrodeposition as provided in the present disclosure is described in detail hereinbelow with reference to examples, but they should not be understood as limiting the protection scope of the present disclosure.

Example 1

(1) $Y(NO_3)_3.6H_2O$ is dissolved in deionized water to prepare a yttrium nitrate solution with a total rare earth ion concentration of 0.5 mol/L; a horseradish peroxidase is added to the yttrium nitrate solution, the content ratio of the horseradish peroxidase to the yttrium nitrate solution being 0.05 mg/mL; ammonium nitrate is added to the mixed solution, the concentration of ammonium nitrate in the mixed solution being 1.5 mol/L, and stirred evenly to obtain a mixed solution;

(2) The mixed solution prepared in step (1) is placed in a water bath, and stirred to make the temperature of the electrodeposition solution reach 25° C. to obtain a standby electrodeposition solution;

(3) A three-electrode system is formed by using an ITO glass as the working electrode, namely the cathode, using a Pt mesh as the counter electrode, namely the anode, and using an Ag/AgCl/$Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −1.10 V, and the deposition time being 8 minutes;

(5) The electrodeposited film obtained in step (4) is rinsed with deionized water and absolute ethanol, respectively, and then dried in an air dry oven at 30° C. for 5 minutes; subsequently, the electrodeposited film is scraped gently from the working electrode with a clean blade to obtain an organic-inorganic hybrid nanoflower formed by compounding the layered rare earth compound as the inorganic carrier with the horseradish peroxidase as the organic component.

The SEM image of the organic-inorganic hybrid nanoflower prepared in this example is as shown in FIG. 1, in which (a) and (b) are SEM images at different magnifications, respectively. It can be seen from FIG. 1 that the organic-inorganic hybrid nanoflower formed by compounding the layered rare earth compound as the inorganic carrier with the biological enzyme as the organic component has a flower-like morphology, and the crystalline form has high regularity.

Figure 2:
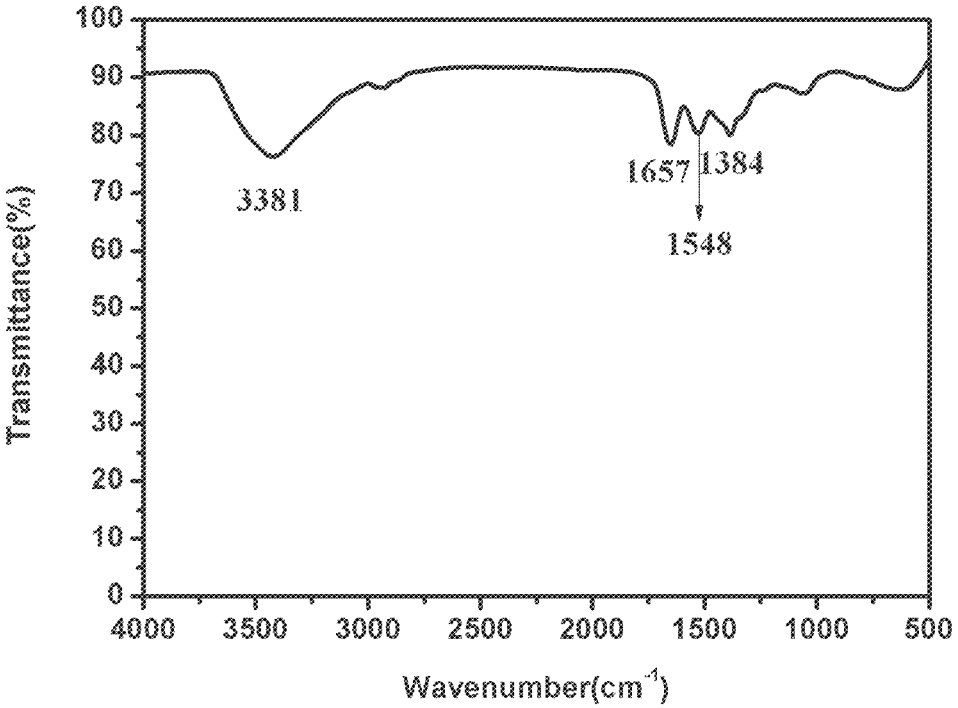
FIG. 2 is a FT-IR spectrum of the organic-inorganic hybrid nanoflower prepared in Example 1.

The FT-IR spectrum of the organic-inorganic hybrid nanoflower prepared in this example is as shown in FIG. 2, in which 1657 $cm^{-1}$ and 1548 $cm^{-1}$ are the primary amide peak and secondary amide peak of the biological enzyme, indicating that the biological enzyme has been successfully loaded on the inorganic carrier.

Figure 3:
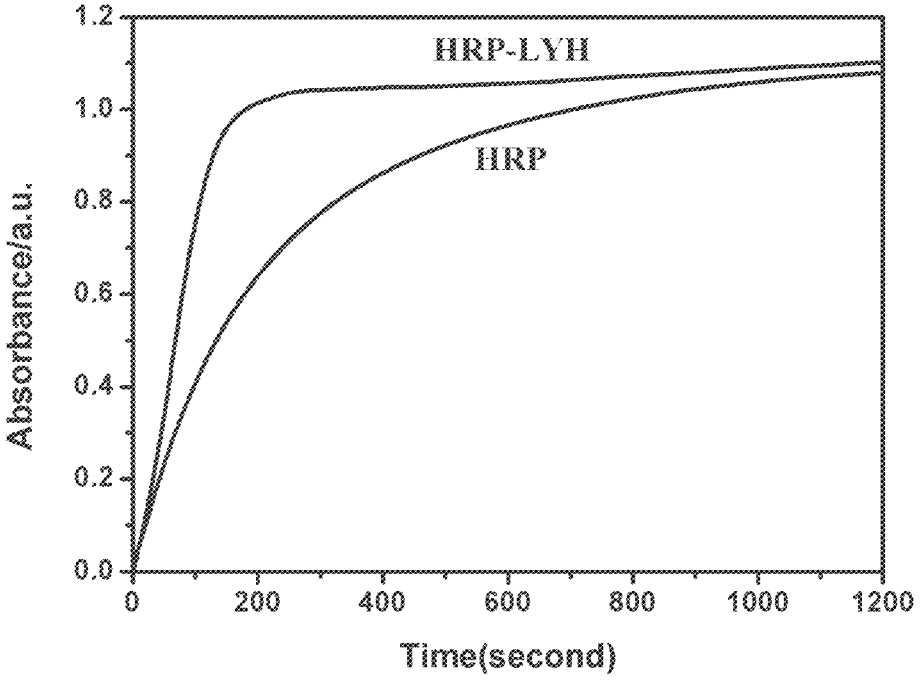
FIG. 3 is a comparison curve of the catalytic performance of the organic-inorganic hybrid nanoflower prepared in Example 1 versus a free enzyme, in which, the upper curve represents the immobilized enzyme, and the lower curve represents the free enzyme.

Using free horseradish peroxidase (denoted as HRP) as a control, the catalytic performance of the organic-inorganic hybrid nanoflower, i.e., immobilized enzyme (denoted as HRP-LYH) prepared in this example, is tested. The test method is: The scraped organic-inorganic hybrid nanoflower powder and free horseradish peroxidase (denoted as HRP) are added to a PBS (25 mM, pH 5.0) buffer solution containing 0.1 mM TMB and $H_2O_2$, respectively, with the enzyme content of each of the organic-inorganic hybrid nanoflower powder and free horseradish peroxidase in the PBS buffer solution being 0.05 mg/mL, and reacted for 20 minutes in the kinetic mode with an ultraviolet spectrophotometer; the absorbance of the solution at 652 nm is monitored at different times. The test results are shown in FIG. 3. In FIG. 3, the upper curve represents the immobilized enzyme, and the lower curve represents the free enzyme. The abscissa in FIG. 3 represents time, and the ordinate represents absorbance. The substance generated by catalysis has an absorbance at 652 nm. As the time increases, the catalysis is proceeding continuously, and reaches the platform, which means that the catalytic process reaches an equilibrium state. By comparing the slope of the comparison curve (free enzyme) to the platform, the degree of catalytic activity can be determined. It can be seen from FIG. 3 that the biological enzyme after immobilization with the layered rare earth compound prepared by the electrodeposition method has higher catalytic activity than the free enzyme.

Example 2

(1) $Dy(NO_3)_3.6H_2O$ is dissolved in deionized water to prepare a dysprosium nitrate solution with a total rare earth ion concentration of 0.05 mol/L; a horseradish peroxidase is added to the dysprosium nitrate solution, the content ratio of the horseradish peroxidase to the dysprosium nitrate solution being 0.8 mg/mL; ammonium nitrate is added to the mixed solution, the concentration of ammonium nitrate in the mixed solution being 0.25 mon, and stirred evenly to obtain a mixed solution;

(2) The mixed solution prepared in step (1) is placed in a water bath, and stirred to make the temperature of the electrodeposition solution reach 30° C. to obtain a standby electrodeposition solution;

(3) A three-electrode system is formed by using an ITO glass as the working electrode, namely the cathode, using a Pt mesh as the counter electrode, namely the anode, and using an $Ag/AgCl/Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −0.8 V, and the deposition time being 20 minutes;

(5) The electrodeposited film obtained in step (4) is rinsed with deionized water and absolute ethanol, respectively, and then dried in an air dry oven at 40° C. for 5 minutes; subsequently, the electrodeposited film is scraped gently from the working electrode with a clean blade to obtain an organic-inorganic hybrid nanoflower formed by compounding the layered rare earth compound as the inorganic carrier with the horseradish peroxidase as the organic component.

Figure 4:
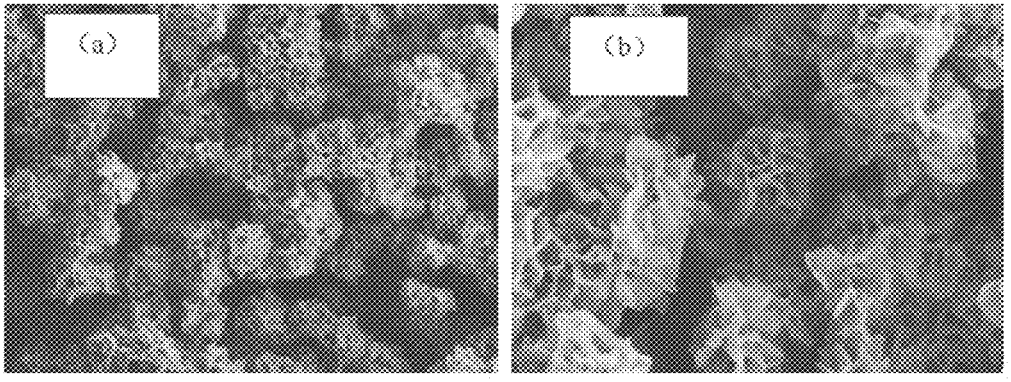
FIG. 4 is an SEM image of the organic-inorganic hybrid nanoflower prepared in Example 2, in which (a) and (b) are SEM images at different magnifications, respectively.

The SEM image of the organic-inorganic hybrid nanoflower prepared in this example is as shown in FIG. 4, in which (a) and (b) are SEM images at different magnifications, respectively. It can be seen from FIG. 4 that the organic-inorganic hybrid nanoflower formed by compounding the layered rare earth compound as the inorganic carrier with the biological enzyme as the organic component has a flower-like morphology, and the crystalline form has high regularity.

Figure 5:
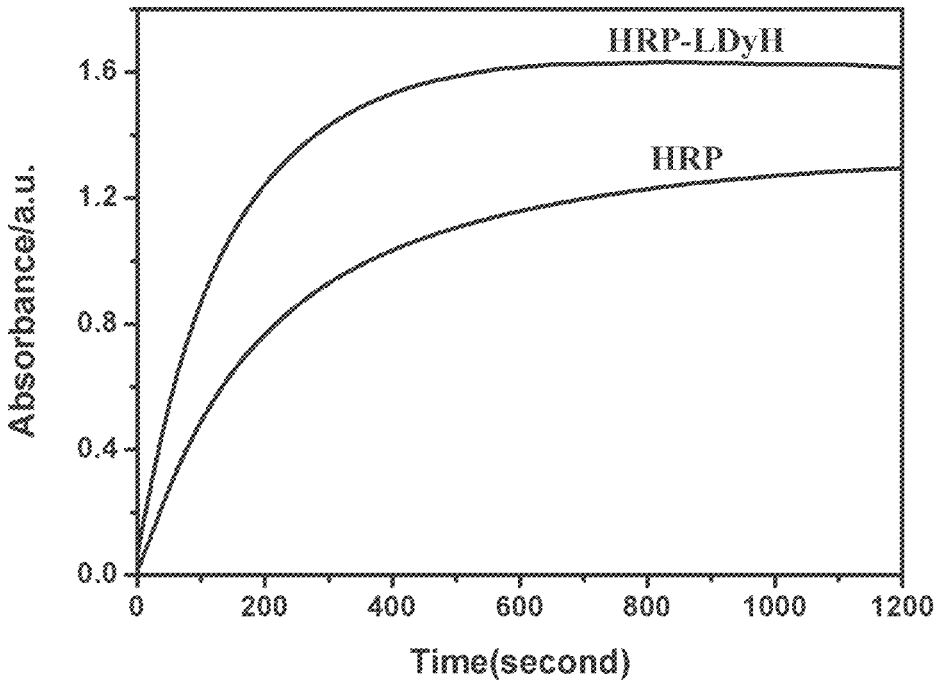
FIG. 5 is a comparison curve of the catalytic performance of the organic-inorganic hybrid nanoflower prepared in Example 2 versus a free enzyme, in which the upper curve represents the immobilized enzyme, and the lower curve represents the free enzyme.

Using free horseradish peroxidase (denoted as HRP) as a control, the catalytic performance of the organic-inorganic hybrid nanoflower, i.e., immobilized enzyme (denoted as HRP-LYH) prepared in this example, is tested according to the method of Example 1 (the enzyme content of each of the organic-inorganic hybrid nanoflower powder and free horseradish peroxidase in the PBS buffer solution is 0.8 mg/mL). The test results are shown in FIG. 5. In FIG. 5, the upper curve represents the immobilized enzyme, and the lower curve represents the free enzyme. It can be seen from FIG. 5 that the biological enzyme after immobilization with the layered rare earth compound prepared by the electrodeposition method has higher catalytic activity than the free enzyme.

Example 3

(1) $La(NO_3)_3.6H_2O$ is dissolved in deionized water to prepare a lanthanum nitrate solution with a total rare earth ion concentration of 0.2 mol/L; a horseradish peroxidase is added to the lanthanum nitrate solution, the content ratio of the horseradish peroxidase to the lanthanum nitrate solution being 0.1 mg/mL; ammonium nitrate is added to the mixed solution, the concentration of ammonium nitrate in the mixed solution being 1.2 mol/L, and stirred evenly to obtain a mixed solution;

(2) The mixed solution prepared in step (1) is placed in a water bath, and stirred to make the temperature of the electrodeposition solution reach 45° C. to obtain a standby electrodeposition solution;

(3) A three-electrode system is formed by using an ITO glass as the working electrode, namely the cathode, using a Pt mesh as the counter electrode, namely the anode, and using an $Ag/AgCl/Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −0.9 V, and the deposition time being 15 minutes;

(5) The electrodeposited film obtained in step (4) is rinsed with deionized water and absolute ethanol, respectively, and then dried in an air dry oven at 45° C. for 4 minutes; subsequently, the electrodeposited film is scraped gently from the working electrode with a clean blade to obtain an organic-inorganic hybrid nanoflower formed by compounding the layered rare earth compound as the inorganic carrier with the horseradish peroxidase as the organic component.

Figure 6:
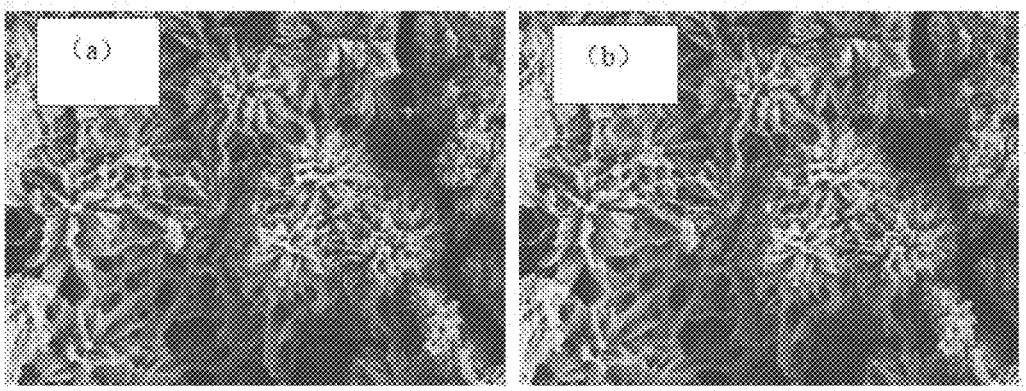
FIG. 6 is an SEM image of the organic-inorganic hybrid nanoflower prepared in Example 3, in which (a) and (b) SEM images at different magnifications, respectively.

The SEM image of the organic-inorganic hybrid nanoflower prepared in this example is as shown in FIG. 6, in which (a) and (b) are SEM images at different magnifications, respectively. It can be seen from FIG. 6 that the organic-inorganic hybrid nanoflower formed by compounding the layered rare earth compound as the inorganic carrier with the biological enzyme as the organic component has a flower-like morphology, and the crystalline form has high regularity.

Figure 7:
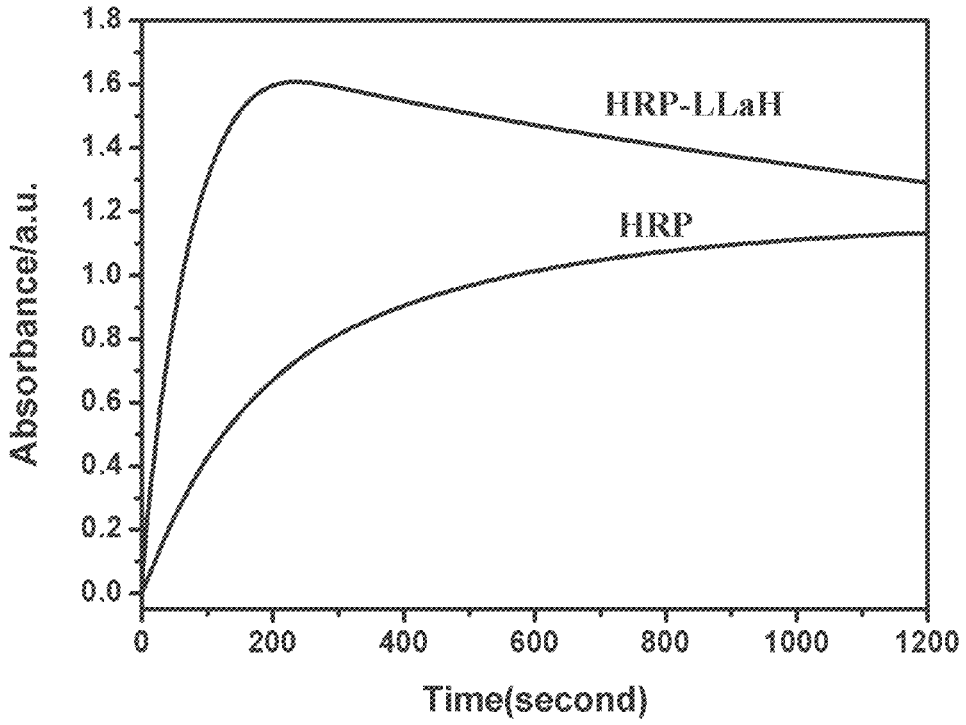
FIG. 7 is a comparison curve of the catalytic performance of the organic-inorganic hybrid nanoflower prepared in Example 3 versus a free enzyme, in which the upper curve represents the immobilized enzyme, and the lower curve represents the free enzyme.

Using free horseradish peroxidase (denoted as HRP) as a control, the catalytic performance of the organic-inorganic hybrid nanoflower, i.e., immobilized enzyme (denoted as HRP-LYH) prepared in this example, is tested according to the method of Example 1 (the enzyme content of each of the organic-inorganic hybrid nanoflower powder and free horseradish peroxidase in the PBS buffer solution is 0.1 mg/mL). The test results are shown in FIG. 7. In FIG. 7, the upper curve represents the immobilized enzyme, and the lower curve represents the free enzyme. It can be seen from FIG. 7 that the biological enzyme after immobilization with the layered rare earth compound prepared by the electrodeposition method has higher catalytic activity than the free enzyme.

Example 4

(1) $Y(NO_3)_3.6H_2O$ is dissolved in deionized water to prepare a yttrium nitrate solution with a total rare earth ion concentration of 0.1 mol/L; an α-amylase is added to the yttrium nitrate solution, the content ratio of the α-amylase to the yttrium nitrate solution being 0.25 mg/mL; ammonium nitrate is added to the mixed solution, the concentration of ammonium nitrate in the mixed solution being 0.4 mol/L, and stirred evenly to obtain a mixed solution;

(2) The mixed solution prepared in step (1) is placed in a water bath, and stirred to make the temperature of the electrodeposition solution reach 35° C. to obtain a standby electrodeposition solution;

(3) A three-electrode system is formed by using an ITO glass as the working electrode, namely the cathode, using a Pt mesh as the counter electrode namely the anode, and using an $Ag/AgCl/Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −1.0 V, and the deposition time being 5 minutes;

(5) The electrodeposited film obtained in step (4) is rinsed with deionized water and absolute ethanol, respectively, and then dried in an air dry oven at 35° C. for 4 minutes; subsequently, the electrodeposited film is scraped gently from the working electrode with a clean blade to obtain an organic-inorganic hybrid nanoflower formed by compounding the layered rare earth compound as the inorganic carrier with the α-amylase as the organic component.

Figure 8:
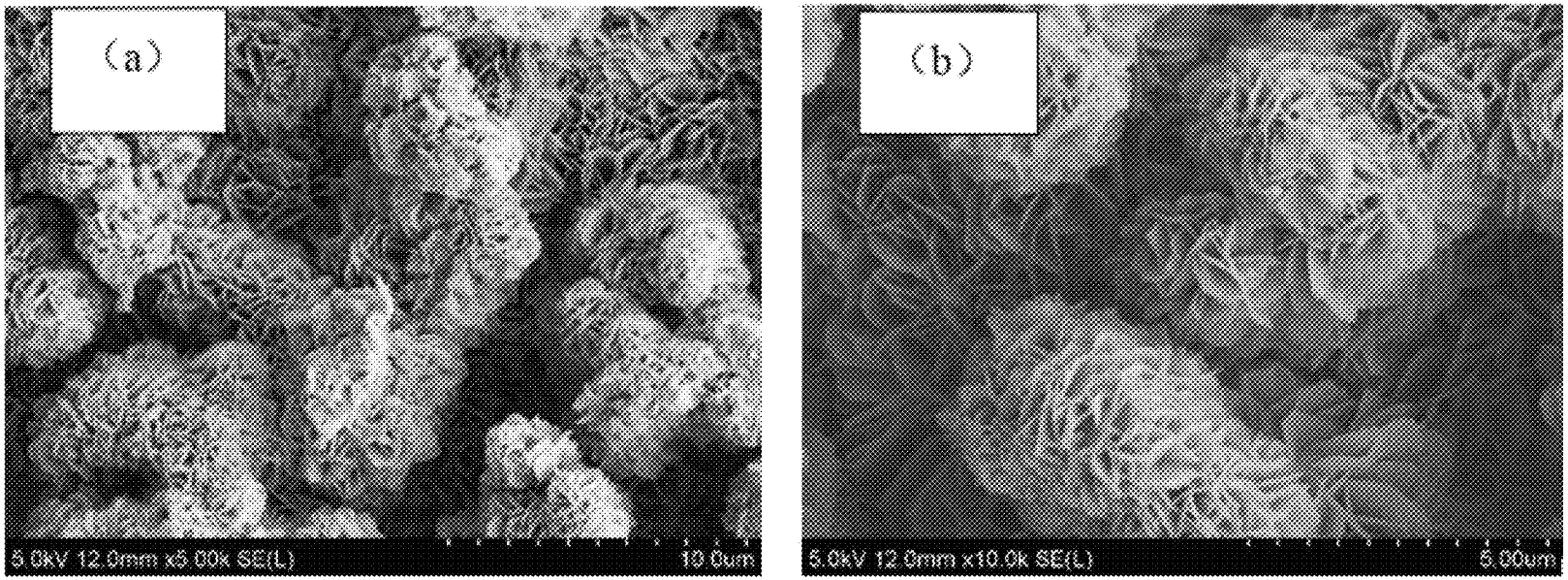
FIG. 8 is an SEM image of the organic-inorganic hybrid nanoflower prepared in Example 4, in which (a) and (b) SEM images at different magnifications, respectively.

The SEM image of the organic-inorganic hybrid nanoflower prepared in this example is as shown in FIG. 8, in which (a) and (b) are SEM images at different magnifications, respectively. It can be seen from FIG. 8 that the organic-inorganic hybrid nanoflower formed by compounding the layered rare earth compound as the inorganic carrier with the biological enzyme as the organic component has a flower-like morphology, and the crystalline form has high regularity.

Figure 9:
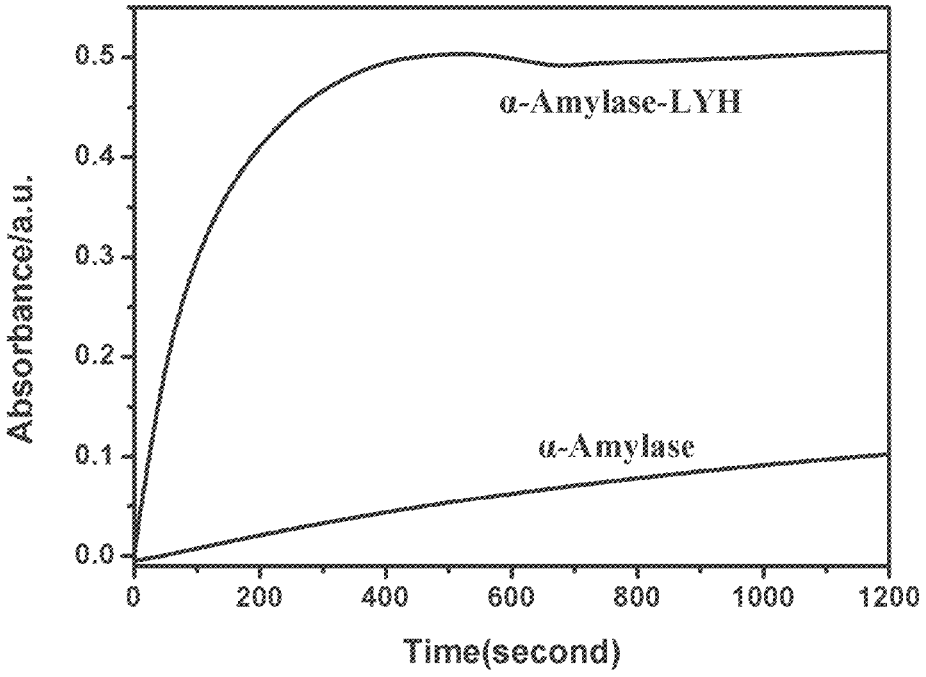
FIG. 9 is a comparison curve of the catalytic performance of the organic-inorganic hybrid nanoflower prepared in Example 4 versus a free enzyme, in which the upper curve represents the immobilized enzyme, and the lower curve represents the free enzyme.

Using free α-amylase (denoted as α-Amylase) as a control, the catalytic performance of the organic-inorganic hybrid nanoflower, i.e., immobilized enzyme (denoted as α-Amylase-LYH) prepared in this example, is tested. The test method is: The scraped organic-inorganic hybrid nanoflower powder and free α-amylase are added to a PBS buffer solution (pH 7.4) containing 0.47 mM CNP-G3 (2-chloro-4-nitrophenylmaltotrioside), respectively, with the enzyme content of each of the organic-inorganic hybrid nanoflower powder and α-amylase in the PBS buffer solution being 0.25 mg/mL, and reacted for 20 minutes in the kinetic mode with an ultraviolet spectrophotometer; the absorbance of the solution at 405 nm is monitored at different times. The test results are shown in FIG. 9. In FIG. 9, the upper curve represents the immobilized enzyme, and the lower curve represents the free enzyme. It can be seen from FIG. 9 that the biological enzyme after immobilization with the layered rare earth compound prepared by the electrodeposition method has higher catalytic activity than the free enzyme.

Example 5

(1) $Y(NO_3)_3.6H_2O$ is dissolved in deionized water to prepare a yttrium nitrate solution with a total rare earth ion concentration of 0.2 mol/L; a laccase is added to the yttrium nitrate solution, the content ratio of the laccase to the yttrium nitrate solution being 1 mg/mL; ammonium nitrate is added to the mixed solution, the concentration of ammonium nitrate in the mixed solution being 1.2 mol/L, and stirred evenly to obtain a mixed solution;

(2) The mixed solution prepared in step (1) is placed in a water bath, and stirred to make the temperature of the electrodeposition solution reach 40° C. to obtain a standby electrodeposition solution;

(3) A three-electrode system is formed by using an ITO glass as the working electrode, namely the cathode, using a Pt mesh as the counter electrode, namely the anode, and using an $Ag/AgCl/Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −1.2 V, and the deposition time being 10 minutes;

(5) The electrodeposited film obtained in step (4) is rinsed with deionized water and absolute ethanol, respectively, and then dried in an air dry oven at 40° C. for 3 minutes; subsequently, the electrodeposited film is scraped gently from the working electrode with a clean blade to obtain an organic-inorganic hybrid nanoflower formed by compounding the layered rare earth compound as the inorganic carrier with the laccase as the organic component.

Figure 10:
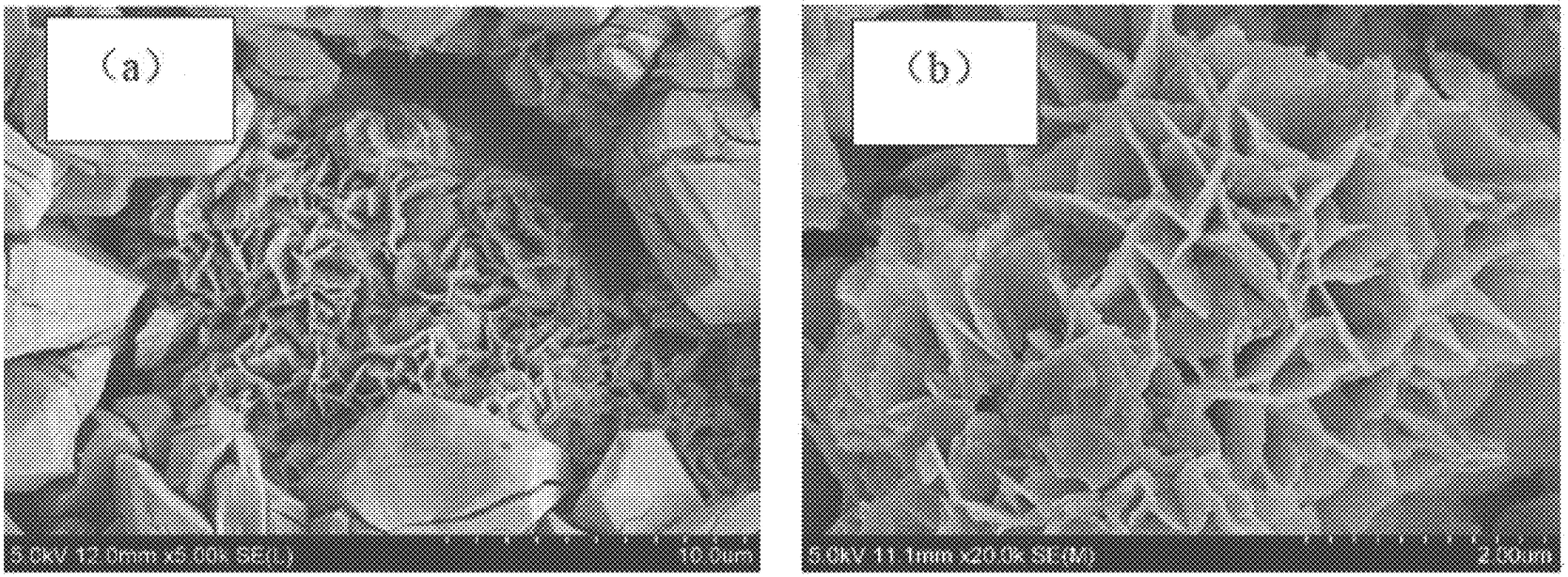
FIG. 10 is an SEM image of the organic-inorganic hybrid nanoflower prepared in Example 5, in which (a) and (b) are SEM images at different magnifications, respectively.

The SEM image of the organic-inorganic hybrid nanoflower prepared in this example is as shown in FIG. 10, in which (a) and (b) are SEM images at different magnifications, respectively. It can be seen from FIG. 10 that the organic-inorganic hybrid nanoflower formed by compounding the layered rare earth compound as the inorganic carrier with the biological enzyme as the organic component has a flower-like morphology, and the crystalline form has high regularity.

Figure 11:
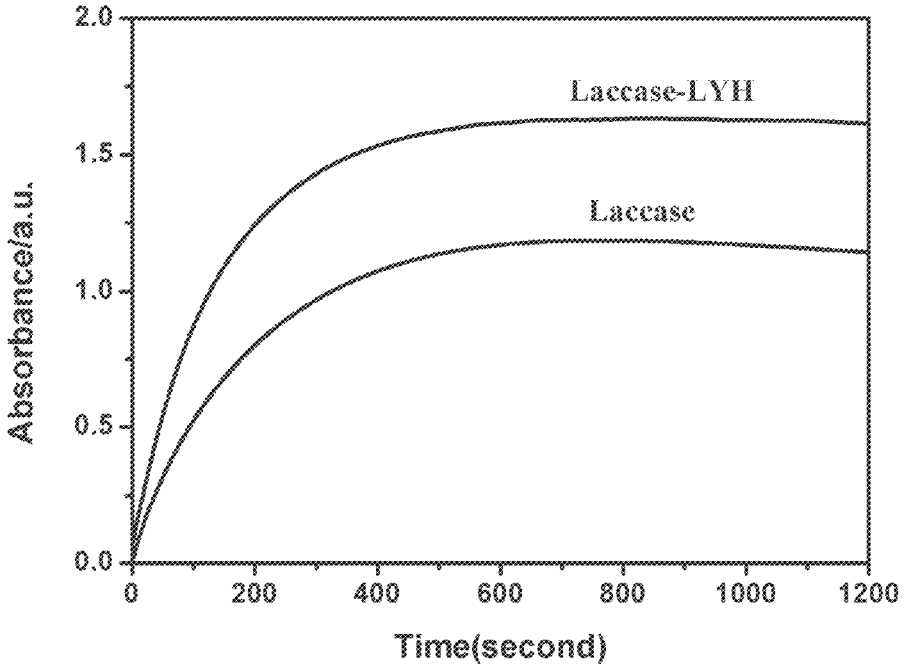
FIG. 11 is a comparison curve of the catalytic performance of the organic-inorganic hybrid nanoflower prepared in Example 5 versus a free enzyme, in which the upper curve represents the immobilized enzyme, and the lower curve represents the free enzyme.

Using free laccase (denoted as Laccase) as a control, the catalytic performance of the organic-inorganic hybrid nanoflower, i.e., immobilized enzyme (denoted as Laccase-LYH) prepared in this example, is tested. The test method is: The scraped organic-inorganic hybrid nanoflower powder and free laccase are added to a PBS buffer solution (pH 6.0) containing an aqueous solution of 4-aminoantipyrine (and an aqueous solution of phenol, respectively, with the enzyme content of each of the organic-inorganic hybrid nanoflower powder and laccase in the PBS buffer solution being 1 mg/mL, and reacted for 20 minutes in the kinetic mode with an ultraviolet spectrophotometer; the absorbance of the solution at 495 nm is monitored at different times. The test results are shown in FIG. 11. In FIG. 11, the upper curve represents the immobilized enzyme, and the lower curve represents the free enzyme. It can be seen from FIG. 11 that the biological enzyme after immobilization with the layered rare earth compound prepared by the electrodeposition method has higher catalytic activity than the free enzyme.

Example 6

(1) $Y(NO_3)_3.6H_2O$ and $Eu(NO_3)_3.6H_2O$ are dissolved in deionized water in a molar ratio of 49:1 to prepare an aqueous solution of mixed rare earth nitrates with a total rare earth ion concentration of 0.25 mol/L; a horseradish peroxidase is added to the solution, the content ratio of the horseradish peroxidase to the rare earth nitrate solution being 0.15 mg/mL; ammonium nitrate is added to the mixed solution, the concentration of ammonium nitrate in the mixed solution being 1 mol/L, and stirred evenly to obtain a mixed solution;

(2) The mixed solution prepared in step (1) is placed in a water bath, and stirred to make the temperature of the electrodeposition solution reach 40° C. to obtain a standby electrodeposition solution;

(3) A three-electrode system is formed by using an ITO glass as the working electrode, namely the cathode, using a Pt mesh as the counter electrode, namely the anode, and using an $Ag/AgCl/Cl^-$ electrode as the reference electrode;

(4) The three-electrode system obtained in step (3) is inserted into the standby electrodeposition solution obtained in step (2) to deposit a layer of electrodeposited film on the cathode material, the deposition voltage being set to be −1.10 V, and the deposition time being 12 minutes;

(5) The electrodeposited film obtained in step (4) is rinsed with deionized water and absolute ethanol, respectively, and then dried in an air dry oven at 40° C. for 4 minutes; subsequently, the electrodeposited film is scraped gently from the working electrode with a clean blade to obtain an organic-inorganic hybrid nanoflower formed by compounding the layered rare earth compound as the inorganic carrier with horseradish peroxidase as the organic component.

Figure 12:
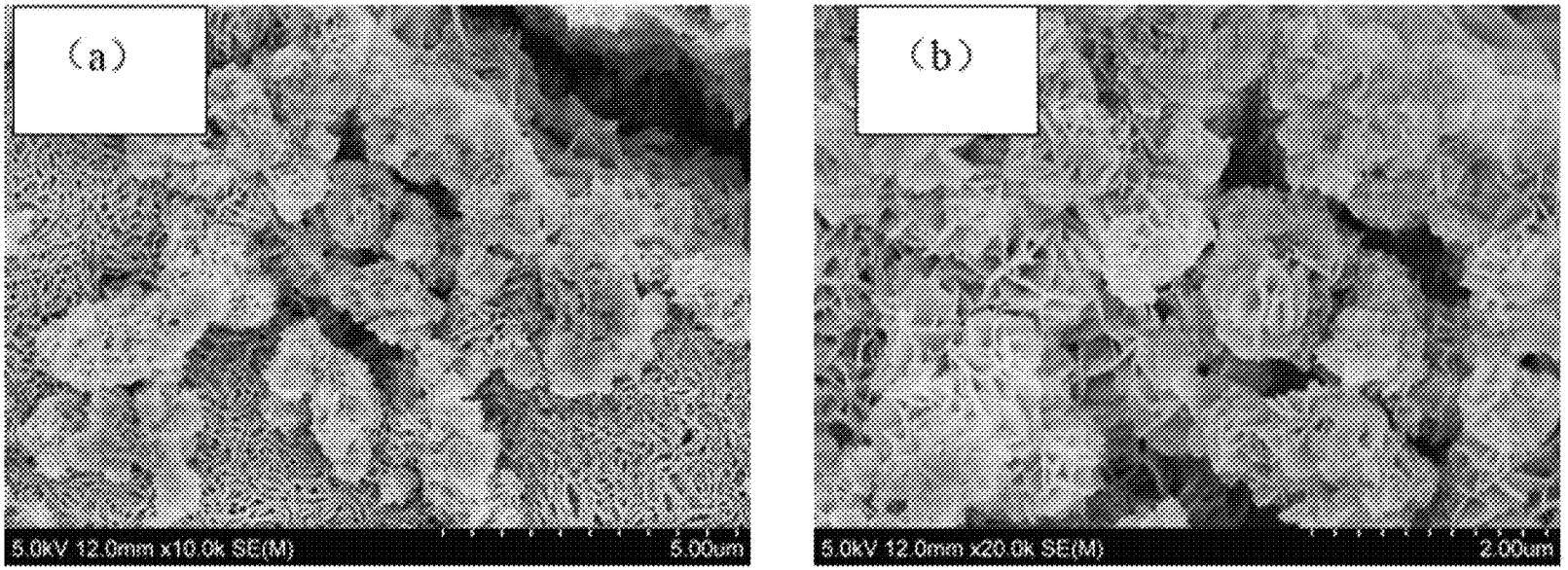
FIG. 12 is an SEM image of the organic-inorganic hybrid nanoflower prepared in Example 6, in which (a) and (b) are SEM images at different magnifications, respectively.

The SEM image of the organic-inorganic hybrid nanoflower prepared in this example is as shown in FIG. 12, in which (a) and (b) are SEM images at different magnifications, respectively. It can be seen from FIG. 12 that the organic-inorganic hybrid nanoflower formed by compounding the layered rare earth compound as the inorganic carrier with horseradish peroxidase as the organic component has a flower-like morphology, and the crystalline form has high regularity.

Figure 13:
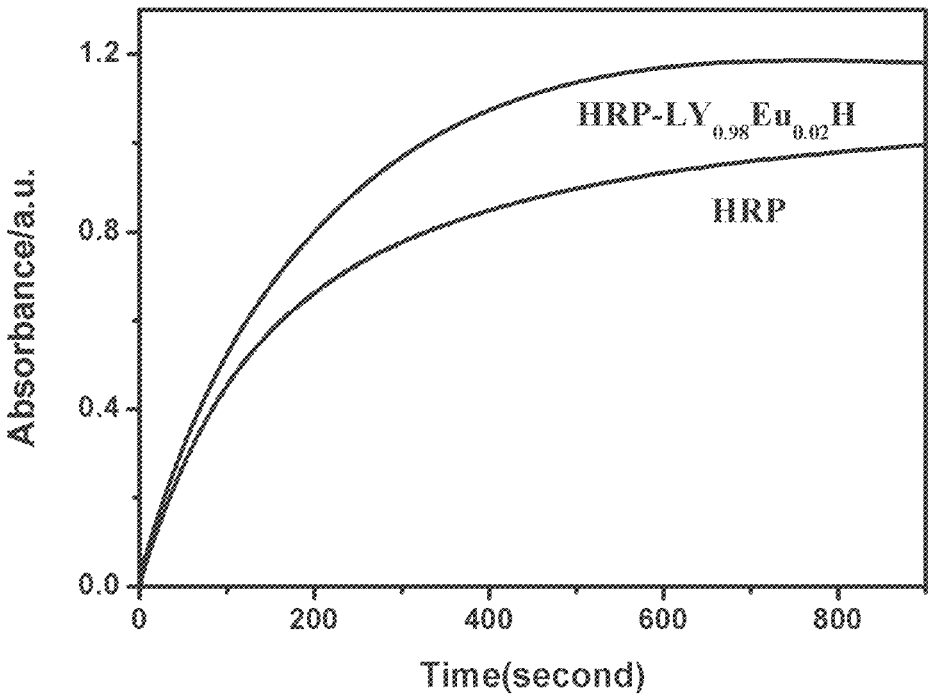
FIG. 13 is a comparison curve of the catalytic performance of the organic-inorganic hybrid nanoflower prepared in Example 6 versus a free enzyme, in which the upper curve represents the immobilized enzyme, and the lower curve represents the free enzyme.

Using free horseradish peroxidase (denoted as HRP) as a control, the catalytic performance of the organic-inorganic hybrid nanoflower, i.e., immobilized enzyme (denoted as $HRP\text{-}LY_{0.98}Eu_{0.02}H$) prepared in this example, is tested according to the method of Example 1 (the enzyme content of each of the organic-inorganic hybrid nanoflower powder and free horseradish peroxidase in the PBS buffer solution is 0.15 mg/mL). The test results are shown in FIG. 13. In FIG. 13, the upper curve represents the immobilized enzyme, and the lower curve represents the free enzyme. It can be seen from FIG. 13 that the biological enzyme after immobilization with the layered rare earth compound prepared by the electrodeposition method has higher catalytic activity than the free enzyme.

It can be seen from the above examples that the present disclosure uses the electrodeposition method to prepare organic-inorganic hybrid nanoflower. The preparation time is shorter; the preparation efficiency is higher; the operation is simple; the conditions are mild; and the crystalline form of the prepared organic-inorganic hybrid nanoflower has high regularity and improves the catalytic performance of biological enzymes.

The above are only the preferred embodiments of the present disclosure. It should be pointed out that for those of ordinary skill in the art, without departing from the principle of the present disclosure, several improvements and modifications can be made, and these improvements and modifications also should be regarded to be within the protection scope of the present disclosure.

What is claimed is:

1. A method for preparing organic-inorganic hybrid nanoflower by electrodeposition, comprising the following steps:

(a) mixing an aqueous solution of a rare earth nitrate with a biological enzyme and a nitrate to obtain a mixed solution; the rare earth ions in the rare earth nitrate are one or more selected from La, Ce, Pr, Nd, Sm, Eu, Gd, Tb, Dy, Ho, Er, Yb and Y ions; the biological enzyme is α-amylase, horseradish peroxidase or laccase;

(b) electrodepositing the mixed solution obtained in step (1) with a three-electrode system consisting of a working electrode, a counter electrode and a reference electrode to obtain an electrodeposited film on the surface of the working electrode; the electrodeposition is a constant voltage deposition, and the deposition voltage is −0.8 to −1.3 v;

(c) washing and drying the electrodeposited film successively to obtain organic-inorganic hybrid nanoflower.

2. The method according to claim 1, wherein the molar concentration of rare earth ions in the aqueous solution of a rare earth nitrate is from 0.005 to 0.5 mol/L.

3. The method according to claim 2, wherein the content ratio of the biological enzyme to the aqueous solution of a rare earth nitrate is 0.001 to 1 mg: 1 mL.

4. The method according to claim 2, wherein the nitrate includes one or more selected from ammonium nitrate, potassium nitrate and sodium nitrate; the molar ratio of the nitrate to the rare earth ion is 1 to 10: 1.

5. The method according to claim 1 or 2, wherein the nitrate includes one or more selected from ammonium nitrate, potassium nitrate and sodium nitrate; the molar ratio of the nitrate to the rare earth ion is 1 to 10: 1.

6. The method according to claim 1, wherein the working electrode includes transparent conductive glass, metal material or carbon material; the counter electrode is a Pt mesh; the reference electrode is an $Ag/AgCl/Cl^-$electrode.

7. The method according to claim 6, wherein the transparent conductive glass is glass coated with an ITO, FTO or AZO layer on one side of the surface.

8. The method according to claim 1, wherein the temperature of electrodeposition is 15 to 60° C.

9. The method according to claim 7, wherein the time of electrodeposition is 1 minute to 3 hours.

10. The method according to claim 9, wherein the molar concentration of rare earth ions in the aqueous solution of a rare earth nitrate is from 0.005 to 0.5 mol/L.

11. The method according to claim 10, wherein the content ratio of the biological enzyme to the aqueous solution of a rare earth nitrate is 0.001 to 1 mg: 1 mL.

12. The method according to claim 10, wherein the nitrate includes one or more selected from ammonium nitrate, potassium nitrate and sodium nitrate; the molar ratio of the nitrate to the rare earth ion is 1 to 10: 1.

13. The method according to claim 9, wherein the nitrate includes one or more selected from ammonium nitrate, potassium nitrate and sodium nitrate; the molar ratio of the nitrate to the rare earth ion is 1 to 10: 1.

14. The method according to claim 9, wherein the working electrode includes transparent conductive glass, metal material or carbon material; the counter electrode is a Pt mesh; the reference electrode is an Ag/AgCl/Cl" electrode.

15. The method according to claim 14, wherein the transparent conductive glass is glass coated with an ITO, FTO or AZO layer on one side of the surface.

16. The method according to claim 9, wherein the temperature of electrodeposition is 15 to 60° C.

17. The method according to claim 1 or 8, wherein the time of electrodeposition is 1 minute to 3 hours.

18. The method according to claim 1, wherein the washing is carried out by using deionized water and absolute ethanol successively.

19. The method according to claim 1, wherein the temperature of drying is 30 to 60° C.

20. Organic-inorganic hybrid nanoflower prepared by the method according to claim 1, having a structure with a flower-like morphology formed by compounding layered rare earth compounds as the inorganic carrier with a biological enzyme as the organic component;

having a chemical composition of $Ln_2(OH)_5NO_3 \cdot nH_2O$, n=1.1 to 2.5;

said Ln being one or more selected from La, Ce, Pr, Nd, Sm, Eu, Gd, Tb, Dy, Ho, Er, Yb and Y;

said biological enzyme being α-amylase, horseradish peroxidase or laccase.

* * * * *